United States Patent [19]

Schweikert

[11] Patent Number: 4,550,940

[45] Date of Patent: Nov. 5, 1985

[54] PALLET-BAR LIFT AND SUPPORT APPARATUS

[76] Inventor: Glen E. Schweikert, 29327 Edgewood Rd., San Juan Capistrano, Calif. 92675

[21] Appl. No.: 574,469

[22] Filed: Jan. 27, 1984

[51] Int. Cl.[4] ..... B66C 1/22

[52] U.S. Cl. ..... 294/67.4; 294/103.1

[58] Field of Search ..... 294/67 E, 67 R, 67 B, 294/67 BB, 67 EA, 103 R, 86 R, 88, 92, 104, 87 R

[56] References Cited

U.S. PATENT DOCUMENTS 3,239,265 3/1966 Scibilia ..... 294/67 E 3,262,595 7/1966 Seib, Jr. et al. ..... 294/103 R

*Primary Examiner*—James B. Marbert

*Attorney, Agent, or Firm*—Francis X. LoJacono

[57] ABSTRACT

The present invention discloses a pallet-bar lift and support apparatus which includes a pair of allochirally arranged lift-support units, each unit having an elongated stabilizer bar, one end of which is provided with a fixed clamp member and the opposite end with a fixed shoulder plate. A second clamp member is slidably mounted on the stabilizer bar so as to be adjusted along the length of the bar and be latched into position, whereby the frame structure of the pallet is clamped between the oppositely disposed clamp members, thus clamping each lift-support unit to the pallet in a firm stabilized manner, the ends of each unit being adapted to be connected to a cable-lift system, or the like.

7 Claims, 5 Drawing Figures

PALLET-BAR LIFT AND SUPPORT APPARATUS

BACKGROUND OF THE INVENTION

1. Field of the Invention

This invention relates generally to a transport and carriage device for freight, and more particularly to an apparatus used for lifting pallets and like platforms on which cargoes are stacked for storage or transportation.

There is a real need for a suitable means for lifting and transporting loaded pallets from one area or location to another, such as when loading and unloading flatbed trucks or trains, and especially ships and like water-related transporation carriers.

A distinct problem prevails when transferring a cargo from ship to shore and vice versa, and this is magnified when a ship is being unloaded or loaded at sea, or a considerable distance from shore, in which case the ship is rolling or pitching due to the various sea conditions. Transfer problems are also worsened by the use of cable systems for lifting loaded pallets.

When the typical cable lift is secured to pallets by other cable connectors or makeshift devices, an unbalanced load will very often tip over, causing loss of the cargo, as well as possible injury to those working in the general area.

To the applicant's knowledge, there is no satisfactory device or means presently available to allow a safe and positive movement of loaded pallets, particularly under the above-mentioned conditions involving cable-loading systems. Hence, the present invention discloses an apparatus that provides a realistic and workable means to eliminate inadvertent dropping of pallet loads, to increase the safety factor, and to improve working conditions for cargo handlers.

It is an important object of the invention to provide a lift device for pallets that is readily compatible for use in conjunction with cable-lift systems, wherein the device includes a pair of longitudinal stabilizer-arm members that interface the oppositely disposed, extended, free ends of the pallet platform and the longitudinal side-beam members. One end of each stabilizer arm is formed with fixed keeper members attached like jaws to receive the side beam therein. The opposite end of each stabilizer bar is provided with a suitable limit bar that is affixed thereto to prevent the second keeper member from sliding off the stabilizer-arm member. The second keeper member is slidably adjustable along the arm member, so as to readily lock each beam member between the opposing keeper members. Thus, each slidable keeper member includes a latch device that allows it to be locked into a clamping position about the side beam member.

Still another object of the present invention is to provide a lifting and loading device of this character wherein the free ends of each-stabilizer arm member are adapted to be connected to a typical cable-lift system, wherein the pallet can be lifted and transported in a substantially even keel without overturning the cargo load, even if the load is unevenly displaced thereon.

It is still another object of the invention to provide a lift device of this type that includes an easily adjustable clamping arrangement wherein relatively few operating parts are required.

A further object of the present invention is to provide a device of this character that is simple to service and maintain.

Still another object of the invention is to provide a device of this character that is relatively inexpensive to manufacture, and simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

For a more complete understanding of the present invention, reference should be made to the accompanying drawings which are for illustrative purposes only wherein.

DESCRIPTION OF THE PREFERRED EMBODIMENT

Figure 1:
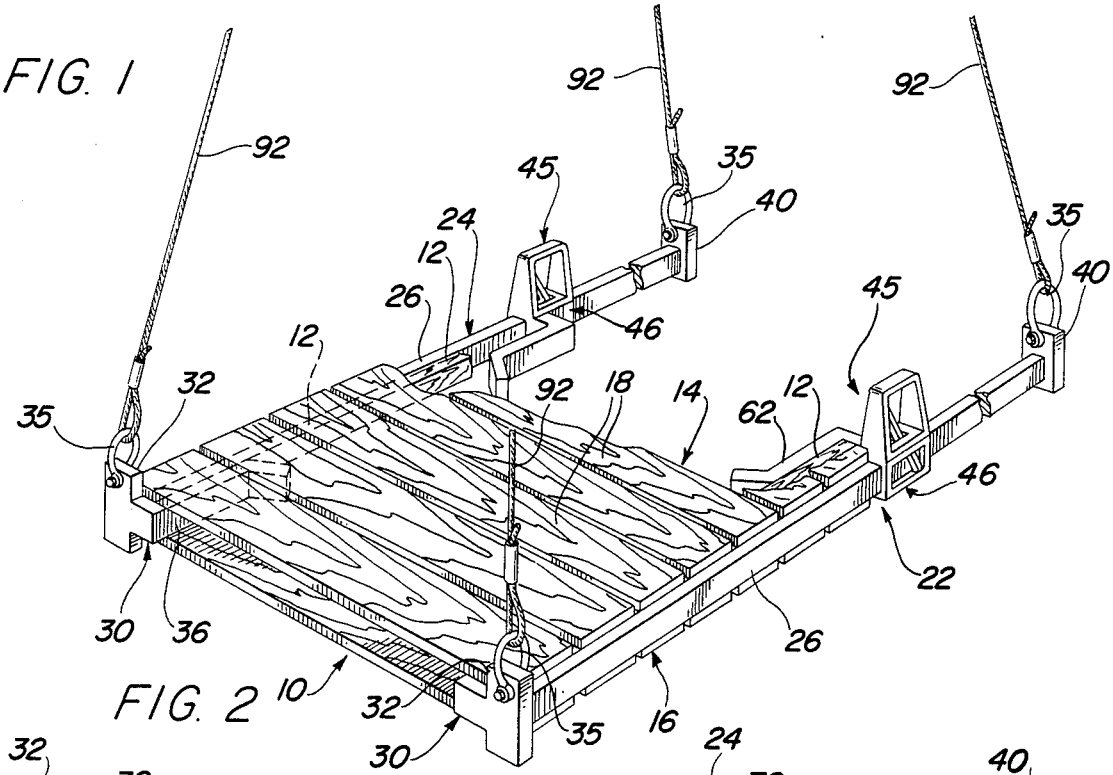
FIG. 1 is a pictorial view of the present invention mounted to a typical pallet having a cable-system arrangement attached thereto.
Figure 2:
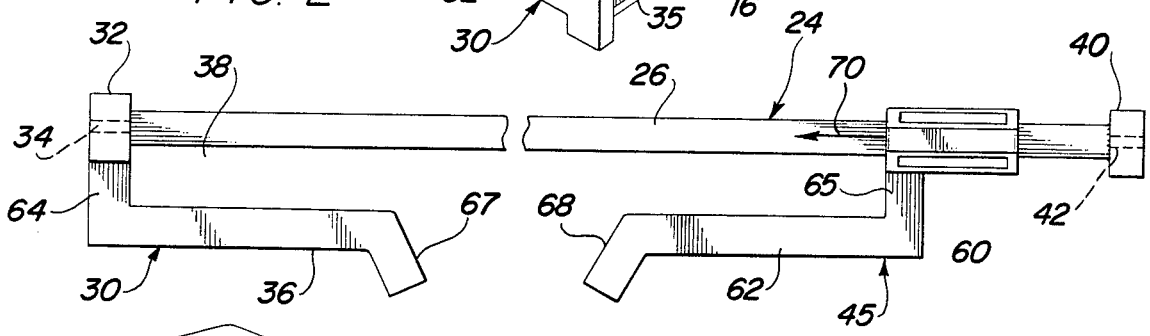
FIG. 2 is a top-plan view of one of the lift units having the stabilizer bar broken away to indicate an undetermined length.
Figure 3:
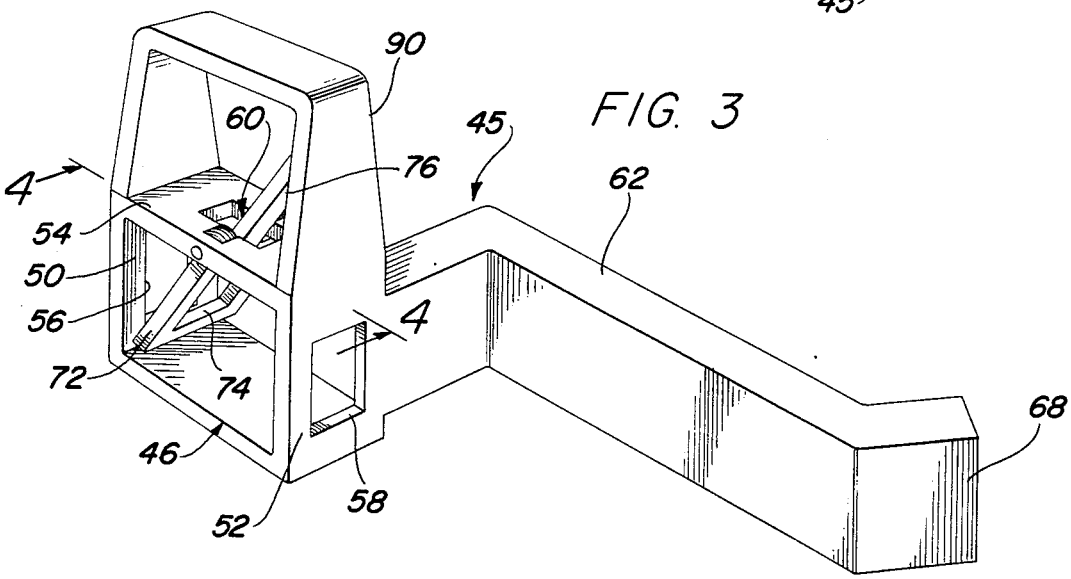
FIG. 3 is an enlarged perspective view of the keeper member that is slidably mounted on the stabilizer bar.
Figure 4:
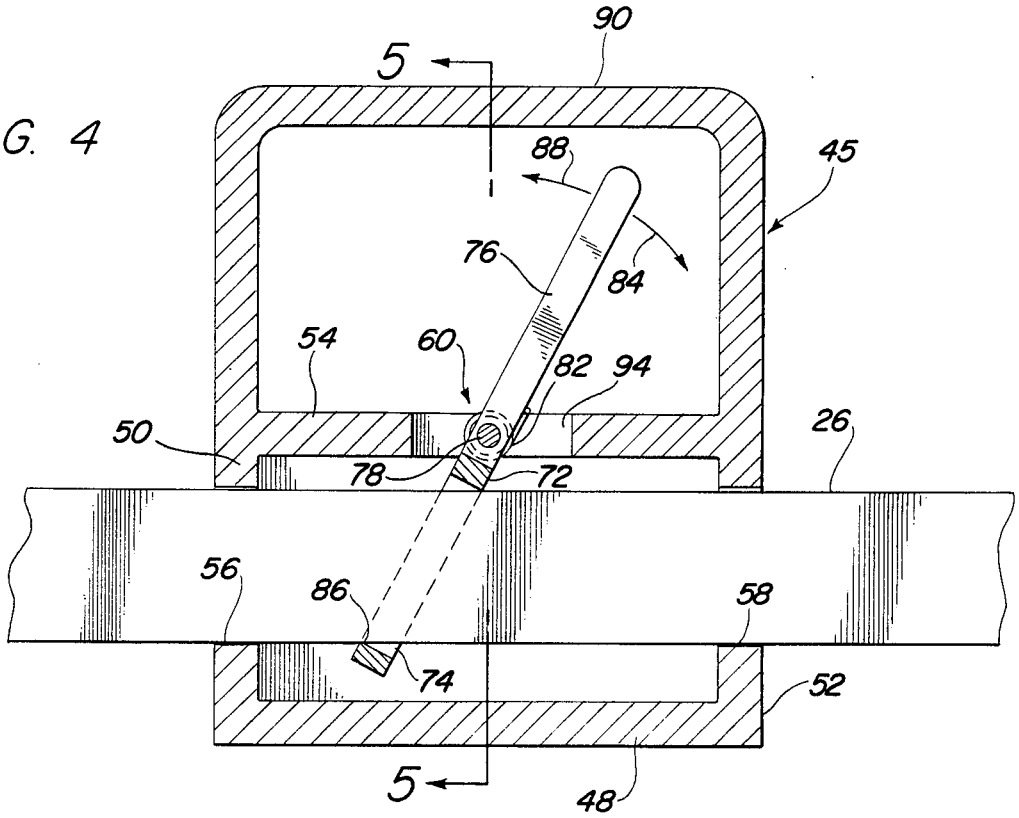
FIG. 4 is an enlarged cross-sectional view of the keeper member taken substantially along line 4—4 of FIG. 3.
Figure 5:
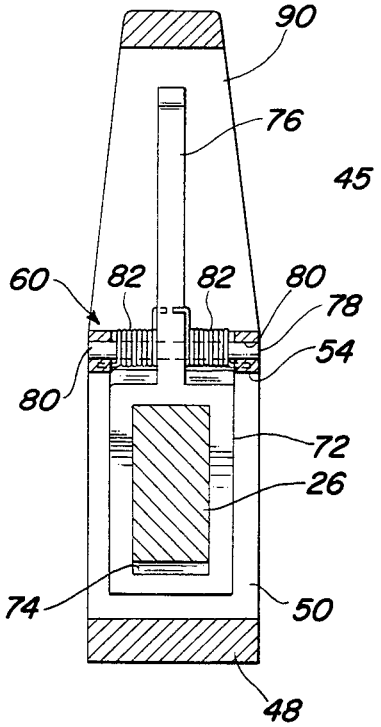
FIG. 5 is a transverse cross-sectional view of the keeper member taken substantially along line 5—5 of FIG. 4.

Referring more particularly to FIG. 1, there is shown a typical pallet, generally indicated at 10, which comprises a pair of spaced-apart side frame or beam members 12 that are interconnected by a pair of oppositely positioned platforms, designated at 14 and 16. The platforms are both formed from a plurality of transversely arranged planks 18, each plank having its oppositely disposed free ends 20 extending outwardly from the side beams 12.

Accordingly, the present invention, which is a lifting device, comprises a pair of lift-support units, indicated generally at 22 and 24, which are alike in configuration but oppositely arranged for right and left positions. However, each unit is constructed having an elongated stabilizer bar 26 which is greater in length than the length of side beams 12, the height thereof being adapted to readily fit between the oppositely disposed platforms 14 and 16.

One end of each stabilizer-bar member, that is the front end, is formed having a fixed keeper means, designated at 30, which is a jaw-like clamp member having a shoulder member 32 vertically attached to the end of bar 26 by a suitable securing means, such as welding. Disposed in the upper portion of shoulder member 32 is a bore 34 to which an eyelet 35 is attached, as illustrated in FIG. 1. Fixed keeper 30 is further provided with a clamp arm 36 which is bent inwardly so as to be readily positioned between the two platforms 14 and 16, and on the inner side of frame members 12, whereby the clamp arm defines a jaw-like opening 38 to receive the frame member 12.

The opposite or rear end of each stabilizer-bar member 6 is further provided with a limit means defined by a shoulder plate 40 having a through bore 42, also adapted to receive an eyelet 35 therethrough. Shoulder plate 40 is affixed to stabilizer bar 26 by welding or other suitable means. However, prior to affixing the shoulder plate to the rear end of bar 26, a second keeper means, generally indicated at 45, is slidably mounted on bar 26 so as to be readily positioned along the stabilizer bar, whereby various sized pallets can, if necessary, be accommodated. Moreover, the second keeper means defines an adjustable clamp member which is formed having a carriage-frame member 46 adapted to slide longitudinally along bar 26, when the unit is mounted to the sides of a pallet.

Carriage frame 46 comprises a bottom wall 48, opposite side walls 50 and 52, and top wall 54. The side walls are provided with apertures 56 and 58, respectively, through which bar 26 passes. Included within the carriage-frame structure is a latching means, indicated at 60, which allows clamping member 45 to be readily latched into a clamping position about one end of side-frame member 12 of the pallet. Hence, carriage member 46 includes a clamp arm 62 similar to clamp arm 36. When mounted to bar 26, clamp arm 62 faces the oppositely disposed fixed clamp arm 36. That is, clamp arm 62 is formed as part of carriage frame 46, and is arranged to project inwardly from the pallet so as to fit between the two platforms 14 and 16. The opposite end of the side frame 12 is then positioned between stabilizer bar 26 and clamp arm 62.

It should be further noted that both clamp arms 36 and 62 are formed having leg members 64 and 65, respectively. Leg member 64 is integrally secured to shoulder member 32, and leg member 65 is integrally formed as part of carriage frame 46. Thus, when each lift-support unit is clamped to the respective side of the pallet, the ends of side-frame members 12 will abut against the respective leg members 64 and 65. In order to provide ease in mounting the keeper means, clamp arms 36 and 62 are also provided with guide members 67 and 68, respectively.

Latching means 60 is arranged to allow a second keeper means 45 to be readily moved to a clamping position, as indicated by arrow 70; but remain latched against rearward movement along bar 26 until latching means 60 is manually actuated. Thus, latching means 60 comprises a latch-tongue member 72 that is pivotally mounted through aperture 74 in top wall 54. Latch-tongue member 62 is formed having an opening 74, the purpose of which is to receive stabilizer bar 26 therethrough; and it includes an extended finger member 76 through which a pivot pin 78 passes. The pin is mounted in bores 80 formed in top wall 54 of the carriage frame, whereby tongue member 72 is biased against bar 26 so as to prevent any rearward movement of the slidable keeper means 45. Biasing means such as coil springs 82 are positioned about pivot pin 78, one end being secured to top wall 54 and the other end being secured to latching tongue 72. Thus, force is applied by the springs in the direction of arrow 84, thereby binding tongue 72 against bar 26 at two points 85 and 86. When keeper means 45 is to be unclamped from pallet 10, finger 76 is manually forced in the direction of arrow 88, thus disengaging the two binding points 85 and 86, at which time keeper means 45 is moved rearwardly along bar 26.

It should be also noted that the carriage frame 46 is provided with a handle 90 which is formed as well to define a protective guard means to prevent latching tongue 72 from being inadvertently actuated.

Accordingly, it can be seen in FIG. 1 that each lift-support unit is firmly clamped to the opposite side of pallet 10, allowing the pallet and its cargo to be lifted and transported in a very stabilized manner by a cable-lift system, such as indicated by cables 92 which are attached to eyelets 35.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A bar-lift and support apparatus for cargoe pallets including a pair of allochirally arranged lift-support units, each of said units comprising:

an elongated stabilizer bar adapted to be mounted along the oppositely disposed side-frame members of a pallet;

a first keeper means fixedly secured to one end of said stabilizer bar so as to be mounted about one end of each of said side-frame members;

a second keeper means slidably mounted for adjustable movement along said stabilizer bar and adapted to be mounted about the opposite end of each of said side-frame members, whereby said pallet is secured between said first and second keeper means of each lift-support unit; and means attached to said second keeper means for latching said second keeper means along said stabilizer bar; and a shoulder plate affixed to the end of said stabilizer bar, and oppositely-disposed from said fixed keeper means.

2. An apparatus as recited in claim 1, wherein said first keeper means comprises:

a shoulder member fixedly secured to said end of said stabilizer bar; and a clamp-arm member integrally formed with said shoulder member and bent inwardly in parallel relation to said stabilizer bar, so as to establish a space therebetween to receive said sideframe member therein.

3. An apparatus as recited in claim 2, wherein said second keeper means comprises:

a carriage frame slidably mounted on said stabilizer bar;

a clamp-arm member integrally formed therewith and bent inwardly in parallel relation to said stabilizer bar, so as to establish a space therebetween to receive said side-frame member therein; and wherein said latching means is mounted in said carriage frame.

4. An apparatus as recited in claim 3, wherein:

said clamp arm of said first keeper means includes an abutment means attached to said shoulder member, and a guide means positioned at the opposite free end of said clamp arm; and said clamp arm of said second keeper means includes an abutment means attached to said carriage frame, and guide means positioned at the opposite free end of said clamp arm of said second keeper means.

5. A bar-lift and support apparatus for cargo pallets including a pair of allochirally arranged lift-support units, each of said units comprising:

an elongated stabilizer bar adapted to be mounted along the oppositely disposed, side-frame member of a pallet;

a first keeper means fixedly secured to one end of said stabilizer bar so as to be mounted about one end of each of said side-frame members;

said first keeper means comprising:

a shoulder member fixedly secured to said end of said stabilizer bar; and a clamp-arm member integrally formed with said shoulder member and bent inwardly in parallel relation to said stabilizer bar, so as to establish a space therebetween to receive said side-frame member therein;

wherein said clamp arm of said first keeper means includes an abutment means attached to said shoulder member, and a guide means positioned at the opposite free end of said clamp arm; and a second keeper means slidably mounted for adjustable movement along said stabilizer bar and adapted to be mounted about the opposite end of each of said side-frame members, whereby said pallet is secured between said first and second keeper means of each lift-support unit;

means attached to said second keeper means for latching said second keeper means along said stabilizer bar;

a shoulder plate affixed to the end of said stabilizer bar, and oppositely-disposed from said fixed keeper means;

said second keeper means comprising:

a carriage frame slidably mounted on said stabilizer bar;

a clamp-arm member integrally formed therewith and bent inwardly in parallel relation to said stabilizer bar, so as to establish a space therebetween to receive said side-frame member therein;

an abutment means attached to said carriage frame, and guide means positioned to the opposite free end of said clamp arm of said second keeper means; and wherein said latching means comprises:

a latching tongue pivotally mounted in said carriage frame and adapted to engage said stabilizer bar in a latched position; and biasing means attached between said latching tongue and said carriage frame, forcing said latching tongue in engagement with said stabilizer bar, so as to prevent said second slidable keeper means from disengaging said pallet.

6. An apparatus as recited in claim 5, wherein said lift-support units include means attached to the respective ends thereof for lifting and transporting said pallet when said units are clamped thereto.

7. An apparatus as recited in claim 5, wherein said latching tongue is formed having an extended finger member and an aperture adapted to receive said stabilizer bar therethrough, so as to latchingly engage said stabilizer bar therein.

* * * * *